United States Patent [19]

Ishizuka

[11] 4,242,136

[45] Dec. 30, 1980

[54] PROCESS FOR PRODUCING METALLIC ZIRCONIUM

[76] Inventor: Hiroshi Ishizuka, 19-2 Ebara 6-chrome, Shinagawa-ku, Tokyo, Japan

[21] Appl. No.: 28,841

[22] Filed: Apr. 10, 1979

Related U.S. Application Data

[63] Continuation-in-part of Ser. No. 808,165, Jun. 20, 1977, abandoned, which is a continuation-in-part of Ser. No. 547,170, Feb. 5, 1975, abandoned.

[51] Int. Cl.[3] ..... C22B 25/00

[52] U.S. Cl. ..... 75/84.5

[58] Field of Search ..... 75/84.5; 266/905, 195

[56] References Cited

U.S. PATENT DOCUMENTS

| | | | |
|---|---|---|---|
| 3,137,568 | 6/1964 | Benner | 74/84.5 |
| 3,692,294 | 9/1972 | Ishimatsu et al. | 75/84.5 |
| 3,966,460 | 6/1976 | Spink | 75/84.5 |

*Primary Examiner*—Benjamin R. Padgett
*Assistant Examiner*—J. L. Barr
*Attorney, Agent, or Firm*—Birch, Stewart, Kolasch and Birch

[57] ABSTRACT

A process for producing metallic zirconium by reacting zirconium tetrachloride vapor with molten magnesium contained in a reducing crucible wherein the zirconium tetrachloride vapor is introduced into the middle surface of the magnesium disposed in the crucible, away from the crucible wall, and the crucible is cooled from the outside, in the course of the reaction, whereby the disposition of the product and by-product within the crucible is such as to permit the effective separation of said product and by-product.

1 Claim, 4 Drawing Figures

PROCESS FOR PRODUCING METALLIC ZIRCONIUM

BACKGROUND AND SUMMARY OF THE INVENTION

This is a continuation-in-part application of application Ser. No. 808,165, filed June 20, 1977. Application Ser. No. 808,165, now abandoned, is in turn a continuation-in-part of application Ser. No. 547,170, filed Feb. 5, 1975 and now abandoned.

The present invention relates to a process for producing metallic zirconium, and more particularly, relates to a process for producing metallic zirconium wherein zirconium tetrachloride is reduced with metallic magnesium and then the obtained metallic zirconium is distilled in vacuum to remove the by-produced magnesium chloride and unreacted metallic magnesium which are present in and adhere to said obtained metallic zirconium.

A prior industrial production of metallic zirconium has been carried out by reducing zirconium tetrachloride with metallic magnesium at a high temperature and under an inert gas atmosphere. In this process, metallic magnesium is charged to a reducing crucible which is provided at a lower part of a retort and is heated to melt and then is reacted with zirconium tetrachloride vapor which is generated by the sublimation of solid zirconium tetrachloride disposed in an upper part of the retort and which is introduced onto the surface of the molten metallic magnesium from the top of the reducing crucible. The obtained zirconium sponge which is deposited on and adheres to the inner wall of the reducing crucible is then subjected to vacuum distillation.

Another process has been proposed for the production of metallic zirconium in which zirconium tetrachloride vapor is fed from outside the retort into the reducing crucible inside the retort to react with molten metallic magnesium contained in a reducing crucible. The by-product magnesium chloride alone is taken out of the reducing crucible, and then the obtained zirconium sponge in the reducing crucible is subject to vacuum distillation.

In both vacuum distilling operations, the entire crucible is placed in a vacuum distillation device maintained at a high temperature and under a reduced pressure, for the removal of the by-products magnesium chloride and the unreacted metallic magnesium from the zirconium sponge.

According to the former process, in the reducing step there are disadvantages in that the velocity of the generation of zirconium tetrachloride vapor is very low, the reaction time is considerably long, the reaction velocity cannot be controlled, and the obtained zirconium sponge is dense. Particularly in the vacuum distillation step there are the disadvantages that the zirconium sponge is subjected to a vacuum distillation together with the entire amount of by-product magnesium chloride and unreacted metallic magnesium by-product, and as a result the amount of zirconium sponge distilled is comparatively small.

According to the latter process, in the reducing step the above-mentioned disadvantages can be overcome but there are still disadvantages in that it is necessary to provide a valve at the upper part of the reducing crucible in order to remove the magnesium chloride impurity which is produced after the completion of the reducing reaction. Since the construction and positioning of this valve are very complicated and the sealing of the valve is very difficult, its use in this process is impractical, particularly in the vacuum distillation step where there are still the same disadvantages as described in the former process.

An object of the present invention is to provide an improved process for producing metallic zirconium which can completely avoid the aforesaid disadvantages in the vacuum distillation of the conventional processes for producing metallic zirconium by reducing zirconium tetrachloride with metallic magnesium.

Another object of the present invention is to provide a process for producing metallic zirconium wherein the major part of the magnesium chloride by-product and unreacted metallic magnesium by-product can be separated from the obtained metallic zirconium without the use of a complicated device.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention is directed to a process for producing metallic zirconium characterized in that a reducing crucible which is deposited with a lower most layer of zirconium sponge and a covering layer of magnesium chloride by-product which are formed by reducing zirconium tetrachloride with metallic magnesium in a reducing reaction device is removed from the reducing reaction device and cut so that the lower portion of the reducing crucible which is deposited with the zirconium sponge is separated from the remaining portion of the crucible containing the magnesium chloride by-product. A plurality of cut portions are accumulated and are piled up in a vacuum distillation device. Then the zirconium sponge which is deposited on the cut portions of the crucible is purified by a vacuum distillation.

BRIEF DESCRIPTION OF THE DRAWINGS

The above objects and advantages of the present invention may be appreciated by referring to the following description, taken in conjunction with the drawings, in which:

In a prior conventional process for producing metallic zirconium, utilizing a device for reducing zirconium tetrachloride as shown in FIG. 1, a pre-solidified zirconium tetrachloride 12 is deposited on an outer coil 1 and an inner coil 2 is heated by heating element 5 to vaporize the zirconium tetrachloride. The obtained zirconium tetrachloride vapor descends in the device and is introduced into a reducing crucible 8 through holes 7' which are provided on a vapor phase can 7. The zirconium tetrachloride vapor is reacted with a molten metallic magnesium 9 to form metallic zirconium 11 and magnesium chloride 10. In FIG. 1, element 3 is a gas valve, element 5 is a heating element, element 6 is a retort, element 13 is a heating element, and element 14 is a baffle plate.

According to yet another process, a device for reducing zirconium tetrachloride as shown in FIG. 2 is utilized wherein a reducing crucible 8 is provided in a retort 15 which is heated by a heating element 16. Zirconium tetrachloride vapor is introduced into the top of the reducing crucible 8 and is reacted with metallic magnesium 9 contained in the reducing crucible 8 to form zirconium sponge 11 and magnesium chloride 10. Since a longer time than that which is necessary for the removal of the impurity such as magnesium chloride is required at the following vacuum distillation of the zirconium sponge in this condition, the impurity such as magnesium chloride is discharged by providing a valve $V_1$ for discharging the impurity at the upper part of the reducing crucible 8. In FIG. 2, $V_2$ is a valve for discharging magnesium chloride from the retort 15.

In the process of the present invention, the cutting of the reducing crucible is carried out because when the metallic zirconium is produced by the reduction of zirconium tetrachloride with metallic magnesium, magnesium chloride and other impurities are formed as a by-product and the separation of these by-products from metallic zirconium requires a remarkably long time even if a vacuum distillation is effected. Therefore, it is possible to reduce the distillation time if a large portion of the magnesium chloride and other impurities have been initially removed from the metallic zirconium before the vacuum distillation is initiated.

According to the present invention, the part of the reducing crucible containing metallic zirconium is cut off from the part of the reducing crucible which contains a large portion of magnesium chloride and other impurities and which is deposited with only a minor amount of metallic zirconium. In this case, it is preferable to cut the reducing crucible at a predetermined height. In short, it is the aim of the present invention to remove a large portion of magnesium chloride and other impurities and thus it is preferable to cut off the remaining portion of the reducing crucible which is deposited with metallic zirconium containing a very small quantity of magnesium chloride and other impurities.

The process of the present invention will be illustratively explained with reference to FIGS. 3 and 4.

Figure 1:
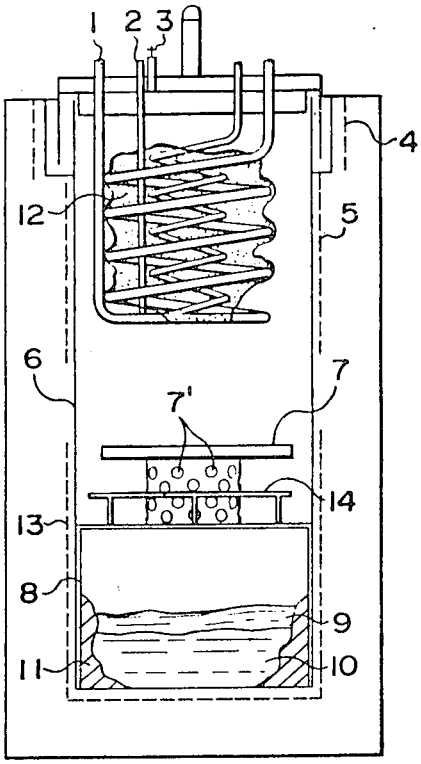
FIG. 1 is a schematic side view, in section, of a conventional device for reducing zirconium tetrachloride.
Figure 2:
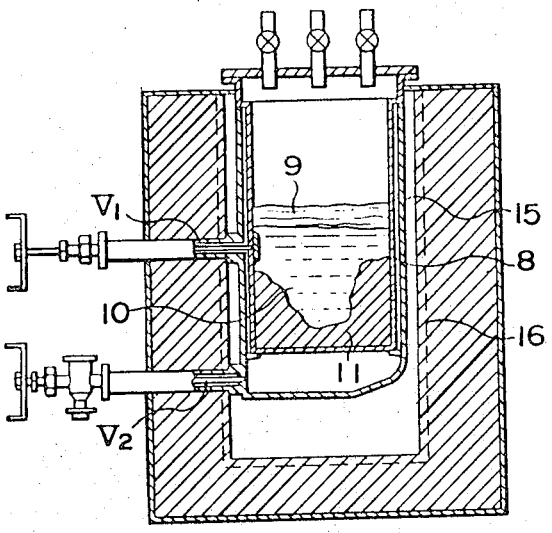
FIG. 2 is a schematic side view, in section, of another conventional device for reducing zirconium tetrachloride.
Figure 3:
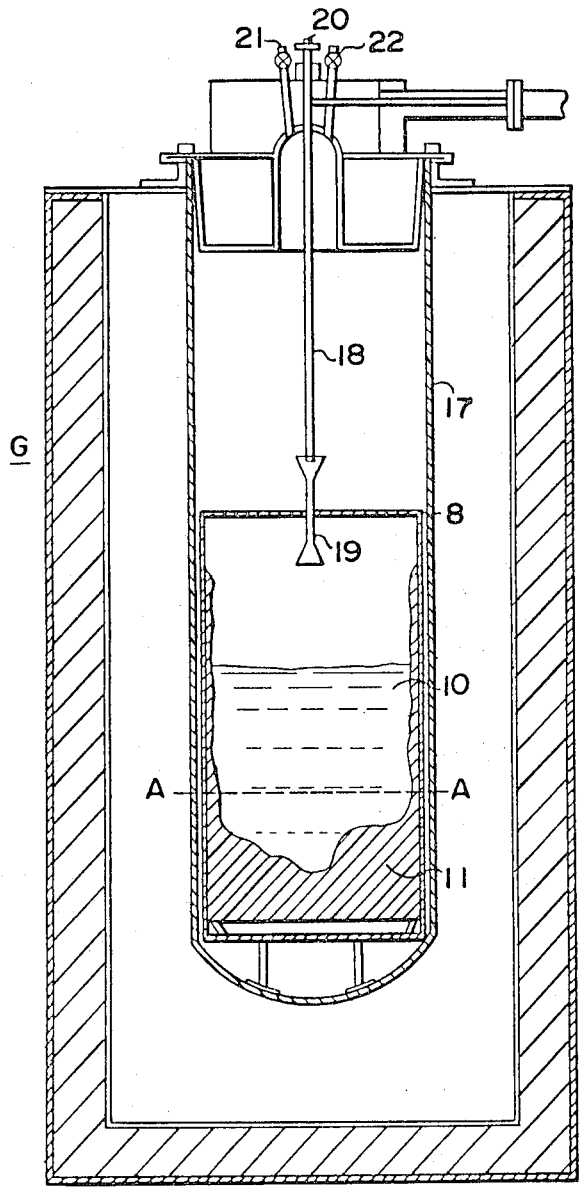
FIG. 3 is a schematic side view, in section, of a device for reducing zirconium tetrachloride which is suitable for practicing the process of the present invention.

Referring to FIG. 3, a reducing crucible 8 is provided in a retort 17 which is heated in a gas furnace G and which is isolated from the air. The reducing crucible 8 is provided with a guide pipe 19 for introduction of zirconium tetrachloride vapor and is degassed to a vacuum and then an inert gas such as Argon gas is introduced thereinto. Then the reducing crucible 8 is heated to a temperature of 800°-900° C. to melt metallic magnesium contained therein. At that time, the pressure in the retort 17 is maintained at about 0.1 kg/cm$^2$ (gauge pressure).

Then, zirconium tetrachloride vapor is introduced into the reducing crucible 8 through a feeding tube 18 and guide pipe 19. In the reducing crucible 8, the zirconium tetrachloride is reacted with a molten metallic magnesium to form zirconium sponge 11 which accumulates on the bottom of the reducing crucible 8. Due to the difference between the specific gravity of the molten magnesium chloride and that of the molten metallic magnesium, the latter overlies the former, and as a result the reduction of zirconium tetrachloride by metallic magnesium proceeds continuously.

When the pressure inside the retort 17 substantially increases and also when zirconium tetrachloride vapor begins to bleed through the bleeding valve 21, the reduction is concluded and then the introduction of zirconium tetrachloride is stopped. When the reducing crucible 8 gets cold, it is taken out of the retort 17 and is cut at the line A—A as shown in FIG. 3 to separate the portion of the crucible containing the zirconium sponge from the remaining portion of the crucible. The remaining magnesium chloride is discharged by a suitable means. In FIG. 3, numeral 10 represents the metallic magnesium, element 20 is a feeding pipe for zirconium tetrachloride vapor, and element 22 is an evacuation pipe.

The lower cut part of the reducing crucible 8 in which the zirconium sponge is contained and from which the magnesium chloride has been removed is transferred to a vacuum distillation device.

The magnesium chloride is removed from the remaining upper part of the reducing crucible 8 which contains a large portion of magnesium chloride and thereafter the magnesium chloride is separated from the zirconium sponge which has adhered to the inner wall of the upper part of the reducing crucible 8. The adhered zirconium sponge is scraped off of the crucible wall by a suitable mechanical means and the thus scraped zirconium sponge is distilled in a vacuum to remove co-existing magnesium chloride and unreacted metallic magnesium. The zirconium sponge is then chlorinated to form zirconium tetrachloride which is reused.

Figure 4:
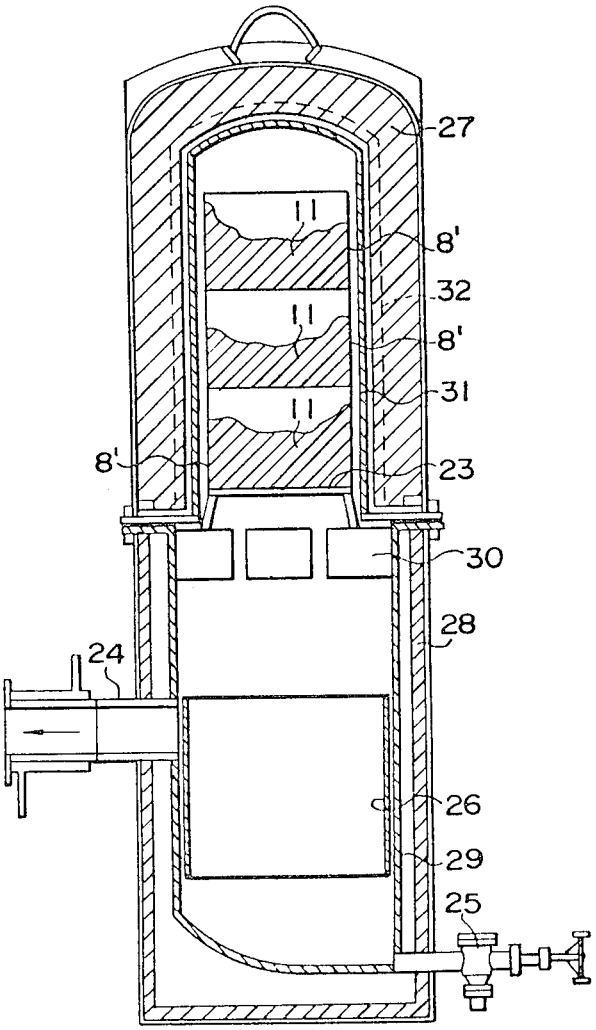
FIG. 4 is a schematic side view, in section, of a vacuum distillation device which is suitable for practicing the process of the present invention.

The vacuum distillation of the zirconium sponge which is present in the lower cut portion of the reducing crucible is carried out in the vacuum distillation device as shown in FIG. 4.

In a lower furnace 28, there is provided a distillate reservoir 29 provided with an evacuation tube 24 at the lower level, a baffle plate 26 along the wall of the reservoir 29 and distillate discharging means 25 at the bottom thereof. The distillate reservoir 29 is also provided with a stand 23 on the rack 30 at the top for mounting in a plurality of lower-cut portions 8' of the reducing crucible containing zirconium sponge 11 (in FIG. 4, the vacuum distillation device contains three such portions). A heated upper furnace 27 for the stack is placed on the lower furnace 28 and over the retort encasing the stack of crucible portions in a sealed manner. In FIG. 4, 31 is a retort and 32 is a heating element.

The zirconium sponge is distilled in a vacuum at a temperature of about 1,000° C. and under a reduced pressure of $10^{-2}$ Torr for several days. It is then cooled, and is taken out of the lower cut part of the reducing crucible 8 in sequence.

As understood from the description set forth above, according to the process of the present invention the space inside the retort 31 of the vacuum distillation device is effectively occupied by a stack of lower cut parts of the reducing crucible which are generally filled with the zirconium sponge, and a small amount of contaminants compared to the amount of the sponge. Thus, the efficiency of the entire operation is considerably increased when compared with that of the prior conventional processes.

In the production of zirconium metal by reducing its chloride with magnesium, a higher reaction rate is preferred because of improvement in the operation efficiency as well as the product structure to facilitate removal of impurities necessarily occluded in the product.

For the production of higher purity zirconium, however, an increased rate of reaction has not been conventionally possible because of the exothermic nature of the reaction. Thus, a higher rate of introduction of zirconium tetrachloride vapor onto the surface of the molten magnesium inevitably results in an increased heat generation which raises the temperature of the crucible wall to a level sufficient to activate contamination, by alloying the zirconium product deposited on the crucible wall with the wall material. In conventional processes, without any means to cool the crucible, the reaction rate would have to be controlled at a relatively low level in order to avoid such overheating and subsequent contamination of the product. The above problem is particularly evident when zirconium chloride vapor is introduced into the crucible in an uncontrolled and unguided manner.

The magnesium bath in the crucible is hottest in the neighborhood of the wall because the crucible has been heated from an outside source in order to maintain the molten state of the magnesium at a temperature sufficient to initiate the reaction with the zirconium tetrachloride vapor. The introduced vapor spreads over the bath surface and the reaction preferentially takes place at the wall of the crucible. The resulting alloying at the crucible wall requires a significant decrease in the reaction rate.

Such a disadvantage has been completely eliminated by following the process of the present invention wherein the crucible is cooled from the outside during the course of the reduction operation. Accordingly, the crucible material and the magnesium bath portion in the vicinity of the crucible wall are provided at a temperature level much lower than that in a zone remote from the crucible wall. This temperature condition provides within the reaction crucible a zone where the reaction can proceed at a significantly increased rate in comparison with conventional techniques, without excessive temperature rise of the crucible as discussed hereinabove. Thus the feeding rate of the zirconium tetrachloride vapor can be substantially increased. This higher rate results in a more spongy structure of the product which is preferred for the easy removal of impurities, such as magnesium metal and its chloride, especially in the purification step by distillation in a vacuum.

Furthermore, a higher reaction rate achieves a more effective process which results in the deposition of a substantial portion of the product in a mass as illustrated in the drawings of the present application. That is, the product deposits in rough separation from the magnesium chloride by-product. In this case, by merely cutting the crucible at a level close to the boundary, one can readily recover a crucible portion which contains a substantial part of zirconium product with little coexistance of magnesium chloride.

Cooling of the crucible can be achieved, according to the present invention, for example, by first extinguishing the burners, which have been heating the crucible from the outside for melting the magnesium and maintaining the temperature of the bath surface above the level sufficient to initiate the reaction, optionally followed by cooling the crucible wall with an outside source, such as, for example, by blowing cold air onto the outside surface of the crucible, use of a cooling jacket, or the like. The blowing of cold air against the crucible is particularly advantageous. The reaction itself goes on effectively in the central zone of the magnesium bath, because the reaction heat maintains the temperature condition for the reaction, once it has been initiated.

Because the alloying of the zirconium sponge with the crucible wall is substantially eliminated, the separation, and recovery of the zirconium sponge is greatly facilitated. This procedure is very suitable for achieving the objects of the present invention wherein the magnesium chloride by-product is roughly removed from the zirconium sponge by cutting away the crucible containing the zirconium sponge. This is possible because the chemical reaction produces a layered deposition with substantially all of the zirconium sponge being deposited in the bottom of the crucible with the magnesium chloride by-product being disposed above the sponge.

In another advantageous feature of the present invention, the zirconium sponge produced by the process of the present invention is substantially free from contamination by the crucible wall material because the reaction takes place in the central portion of the molten magnesium, far away from the crucible wall, and thus the heat formed by the reaction has very little influence on the temperature of the crucible wall which means that any contamination of the wall is not activated. This is true even when the reaction proceeds very quickly as compared with conventional processes because only a small amount of zirconium sponge is actually in contact with the wall as a possible contaminant.

In the reaction process, magnesium chloride which is formed as a by-product during the reaction, is trapped to some degree in cavities of zirconium sponge and vacuum distillation is usually required for the removal of the by-product. Since the zirconium sponge formed according to the present invention is coarse and very porous due to the high feeding rate of the zirconium tetrachloride vapor, when compared to the prior art, the by-product can be quite readily removed from the sponge. In addition, a high distillation efficiency can be achieved with respect to both time and energy by collecting a plurality of lower portions of crucibles, placing them in a stack, and vacuum distilling all of said crucible portions at the same time. This is possible because the major portion of the magnesium chloride by-product has been cut away from the zirconium sponge prior to being placed in the vacuum distillation device and, in addition, at least twice as much of the zirconium sponge, as compared with conventional techniques can be subjected to vacuum distillation due to the fact that the height of the container which houses the sponge is reduced when the zirconium sponge is cut away from the magnesium chloride by-product. After vacuum distillation, it is also possible to reassemble the various portions of the crucibles for reusage, thus providing a substantial saving in material consumption.

According to the conventional processes, the reaction of zirconium tetrachloride vapor with molten magnesium, proceeds preferentially in the neighborhood of the wall of the crucible which contains the magnesium because the magnesium is hottest at its point of contact with the wall because the heat is supplied to the wall of the crucible from an outside source. Therefore, although the zirconium tetrachloride vapor may be introduced over the entire surface of the molten magnesium, the reaction primarily takes place at the wall of the crucible. Since the reaction is exothermic and if the reaction proceeds too quickly, the temperature will rise high enough to alloy the sponge with the wall material. Thus, in order to avoid the alloying of the sponge material with the wall material of the crucible, which produces an impure zirconium sponge, a comparatively low feeding rate of the zirconium tetrachloride vapor must be utilized in the prior art. In addition, the zirconium sponge thus formed is comparatively dense. Thus, since the zirconium sponge thus formed is deposited substantially on the wall of the crucible in a dense form, the entire crucible must be placed in a vacuum distillation device for the removal of the by-product. This requires the use of large equipment for separating the zirconium sponge from the by-product, relative to the amount of zirconium sponge to be treated.

The operation of the present invention will now be more specifically described in connection with at least two reducing devices as shown in FIG. 3 and the vacuum distilling device as shown in FIG. 4.

The reducing crucible is charged with 850–1000 kg of metallic magnesium and is placed inside the retort. The space inside the retort is degassed to a vacuum and heated to a temperature of 250°– 300° C., and thereafter the space is filled with Argon gas at a pressure of about 0.1 kg/cm$^2$.

Then the retort is heated to a temperature of 800° C. to melt the metallic magnesium therein and the temperature is maintained for 5 to 8 hours. The pressure inside the retort is maintained for about 0.1 kg/cm$^2$ by occasionally bleeding the retort in case of a remarkable pressure rise. Zirconium tetrachloride vapor is introduced at a rate of 65 kg/h through the feeding tube into the reducing crucible with the initial pressure inside the storage tank (not shown) for zirconium tetrachloride being 1.2–1.5 kg/cm$^2$. In the introduction of zirconium tetrachloride, a differential pressure inside the storage tank and the retort is maintained at 0.1–0.2 kg/cm$^2$. The pressure inside the retort is maintained at 0.1–0.2 kg/cm$^2$ by occasionally bleeding the retort when there is a remarkable pressure rise. The reducing operation is carried out at a temperature of about 850° C. for 30–40 hours with the zirconium sponge being produced at a rate of 25 kg/h on an average. By bleeding the zirconium tetrachloride vapor when there is a remarkable pressure rise inside the retort, the conclusion of the reducing reaction is recognized.

After several hours of cooling following the conclusion of the reaction, the reducing crucibles are taken out of the furnace, cut as shown along the line A—A of FIG. 3, and separated from the magnesium chloride. The magnesium chloride remaining in the upper part of the reducing crucible is pressed out mechanically, and the zirconium sponge which has adhered to the reducing crucible wall is mechanically scraped therefrom and the scraped zirconium sponge is separated from the magnesium chloride and the other impurities, e.g., unreacted metallic magnesium, by vacuum distillation and crushed into lumps for chlorination of the zirconium sponge. The lower portions of the reducing crucibles which have been cut are piled up together in a vacuum distillation device for removal of magnesium chloride, unreacted metallic magnesium and other contaminants from the zirconium sponge, under a reduced pressure of $10^{-2}$ mmHg and a temperature of about 1000° C. for a week. The zirconium sponge is discharged from the lower portion of the reducing crucibles which have been withdrawn from the vacuum distillation device and is crushed into a given product.

After three runs of vacuum distillation (for nine batches), the furnace is heated to 800° C. to melt metallic magnesium for recovery into a ladle (not shown). The metallic magnesium thus recovered is used again for the reduction of zirconium tetrachloride after the washing of the metallic magnesium with an acid.

The lower part of the reducing crucible which is now free from zirconium sponge is welded to the upper cut part of the reducing crucible for re-use in the reducing reaction.

It would be readily understood by those skilled in the art that various advantages are achieved from the features of the present invention as described above in detail. For example, in the reduction step:

(1) Because of the forced introduction of non-diluted $ZrCl_4$ vapor, onto Mg, the reaction proceeds at a very high rate in comparison with the conventional case where diffusion in an inert gas is employed for the introduction of the $ZrCl_4$ vapor;

(2) Because $ZrCl_4$ is introduced onto the middle surface of the Mg, or in a zone away from the crucible wall, and because the crucible wall is externally cooled the heat generated by the exothermic reaction does not raise the temperature of the crucible wall, and thus a high reaction rate is achieved without danger of alloy formation of the Zr product with the crucible wall material, in comparison with a conventional case where such introduction is made over the entire Mg surface;

(3) Substantial reaction of $ZrCl_4$ with Mg takes place substantially at the middle of the crucible rather than in the neighborhood of the crucible wall, because the Mg temperature in the neighborhood of the wall can be maintained at a low level, for the reason as set forth in (2); and (4) The Zr sponge product can be obtained in a very porous form because a high reaction rate of $ZrCl_4$ vapor with Mg is possible. Such a form is very advantageous in that by-product $MgCl_2$ and unreacted Mg are very easily removed by distillation in a vacuum.

Because the present invention contemplates the removal of the majority of the by-product and impurities for reducing the required time, by just cutting the reducing crucible together with the content before the zirconium sponge product is subjected to vacuum distillation, the following advantages can be achieved:

(1) The vacuum distillation device is effectively charged with a stack of lower cut portions of the reducing crucible which are substantially filled with the zirconium sponge, and a small amount of contaminants compared with the sponge. Thus, the efficiency of the entire operation is considerably increased when compared with that of the prior conventional processes;

(2) Smaller devices can be utilized for a single Zr product;

(3) Because of the reason of (1), the number of necessary vacuum distillation devices is the same or less than the number of reducing furnaces (at most, the number of vacuum distillation devices and the number of reducing furnaces are the same);

(4) The reducing furnaces and the reducing crucible are free from any complicated means for discharging $MgCl_2$ by-product to the outside of the furnace, because such by-products are removed in the solid phase outside the furnace; and (5) Because of the removal, in advance of a substantial part of the by-product, the treating time can be shortened in the distillation device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A process for producing metallic zirconium by reacting zirconium tetrachloride vapor with molten magnesium contained in a reducing crucible which process comprises:

(1) Introducing zirconium tetrachloride vapor through a guide pipe means extending above and towards molten magnesium contained in a reducing crucible, said crucible being enclosed in a retort which is separately provided from a storage tank for the zirconium tetrachloride vapor, said vapor being introduced onto the middle surface of the magnesium with a differential pressure of 0.1 to 0.2 $kg/cm^2$ between said retort and said storage tank, said reducing crucible being cooled from the outside in the course of the reaction thus caused between the zirconium tetrachloride with magnesium in the middle surface of the magnesium in a zone away from the crucible wall so as not to raise the temperature of said crucible wall and thereby eliminating the alloy formation of the zirconium product with the crucible wall material, to result in a preferred zirconium sponge layer deposit disposed at the bottom of said crucible, which contains the magnesium, with little adhesion of the sponge to the wall of the crucible, said sponge layer being covered by a layer of magnesium chloride by-product;

(2) freezing the by-product;

(3) cutting the crucible which contains zirconium sponge and the entire solid magnesium chloride by-product substantially horizontally and at a level such that substantially all of the zirconium sponge is separated from the by-product and thus contains only a small amount of said by-product;

(4) collecting a plurality of cut crucibles obtained by such reaction operations;

(5) placing said plurality of crucibles, which contain the zirconium sponge, together in a stack in a vacuum distilling device;

(6) heating said plurality of crucibles to remove any remaining by-product at a temperature high enough to evaporate said by-product; and (7) recovering the purified zirconium sponge.

* * * * *